US007684734B2

(12) United States Patent
Sato

(10) Patent No.: US 7,684,734 B2
(45) Date of Patent: Mar. 23, 2010

(54) METHOD FOR ASSEMBLING DRUM DRIVE UNIT CAPABLE OF REDUCING DRUM ROTATIONAL SPEED FLUCTUATIONS AND IMAGE FORMATION APPARATUS CONTAINING A DRUM DRIVE UNIT

(75) Inventor: Yoji Sato, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 321 days.

(21) Appl. No.: 11/741,060

(22) Filed: Apr. 27, 2007

(65) Prior Publication Data

US 2007/0253735 A1 Nov. 1, 2007

(30) Foreign Application Priority Data

Apr. 28, 2006 (JP) ..... 2006-126473

(51) Int. Cl.
*G03G 15/00* (2006.01)

(52) U.S. Cl. ..... 399/167

(58) Field of Classification Search ..... 399/167
See application file for complete search history.

(56) References Cited

FOREIGN PATENT DOCUMENTS

| | | |
|---|---|---|
| JP | 7-92761 | 4/1995 |
| JP | 2002-311672 | 10/2002 |
| JP | 2003-233236 | 8/2003 |

OTHER PUBLICATIONS

Chines Office Action dated Dec. 19, 2008 corresponding to U.S. App. No. 11/741,060, filed Apr. 27, 2007.

*Primary Examiner*—Quana M Grainger
(74) *Attorney, Agent, or Firm*—Turocy & Watson, LLP

(57) ABSTRACT

In a tandem type image formation apparatus, a drum drive unit which always simultaneously drives respective photoreceptor drums, is assembled such that it is possible to synchronize cycles of rotational speed fluctuations of the respective photoreceptor drums in assembling. In this manner, the photoreceptor drums rotate so as to synchronize the cycles of rotational speed fluctuations of the photoreceptor drums even after assembling. Therefore, a phase difference in the cycles of rotational speed fluctuations of the photoreceptor drums is determined, and the photoreceptor drums are assembled so as to be shifted by the phase difference.

20 Claims, 8 Drawing Sheets

METHOD FOR ASSEMBLING DRUM DRIVE UNIT CAPABLE OF REDUCING DRUM ROTATIONAL SPEED FLUCTUATIONS AND IMAGE FORMATION APPARATUS CONTAINING A DRUM DRIVE UNIT

CROSS-REFERENCE TO RELATED APPLICATIONS

This application is based upon and claims the benefit of priority from prior Japanese Patent Application No. 2006-126473, filed Apr. 28, 2006, the entire contents of which are incorporated herein by reference.

BACKGROUND OF THE INVENTION

1. Field of the Invention

The present invention relates to a method for assembling a drum drive unit which drives photoreceptor drums and an image formation apparatus having the drum drive unit, and in particular, to a technology of synchronizing rotational speeds of a plurality of photoreceptor drums.

2. Description of the Related Art

An image formation apparatus carrying out image formation by use of an electrophotographic system has been known.

In such an image formation apparatus, an electrostatic latent image is formed on a surface of a photoreceptor drum, and a toner image is formed by making toner adhere to the electrostatic latent image by a developing machine.

Next, the toner image is transcribed onto a recording medium such as paper, an OHP, or the like, and the toner image transcribed on the recording medium is fixed with a fixing machine. Among such image formation apparatuses, there is a tandem type image formation apparatus which uses a plurality of photoreceptor drums, and forms a color image by sequentially superimposing respective color toner images formed on the respective photoreceptor drums, on an intermediate transcriptional body.

In such a tandem type image formation apparatus, it is necessary for the respective photoreceptor drums to rotate at a constant rotational speed and at an equivalent angular velocity. Namely, when the respective photoreceptor drums are uneven in rotational speeds, there occurs the problem that misalignment in the toner images is brought about depending on respective colors at the time of transcribing toner images onto an intermediate transcriptional body, which makes it impossible to carry out satisfactory image formation.

However, the respective photoreceptor drums respectively fluctuate in rotational speeds with a cycle. As factors of the rotational speed fluctuations of the photoreceptor drums, there can be quoted mesh errors among driving force transmission members which are on the shafts of the photoreceptor drums, and transmit a rotation to the shafts of photoreceptor drums, and the like.

The mesh errors will be described. In driving force transmission members prepared by injection molding, mesh errors as shown in FIG. 4 are brought about in consequence of a structure of a metallic mold in the manufacturing process. FIG. 4 is a graph in which mesh errors of gears are measured by a mesh tester. When an attempt is made to transmit a driving force by meshing a driving force transmission member in which a mesh error is brought about with a driving force transmission member in which there is no mesh error, rotational speed fluctuations at a constant cycle are brought about depending on an extent of the meshing between the driving force transmission members.

Due to the driving force transmission members rotary-driven with rotational speed fluctuations in a constant cycle, the photoreceptor drums to which a driving force is coaxially transmitted from the driving force transmission members have the same rotational speed fluctuations as those in a constant cycle of the driving force transmission members under the influence of the rotational speed fluctuations of the driving force transmission members. Therefore, at the time of transcribing respective color toner images formed on the photoreceptor drums, onto a non-transcriptional body such as an intermediate transcriptional body or the like, misalignment in the toner images is brought about depending on the respective colors, which brings about color shift.

As means for solving this problem, there can be employed a method in which the precision in molding the driving force transmission members is improved, which eliminates mesh errors of the driving force transmission members. However, the precision can be raised only to a certain extent in consideration of mass productivity or the like. Then, conventionally, there has been a tandem type image formation apparatus which has a driving motor rotary-driving photoreceptor drums, and in which rotational speeds of the photoreceptor drums are synchronized due to the respective photoreceptor drums independently controlling the mechanism that detects rotational speeds of the photoreceptor drums by use of means such as a photosensitive element or the like, and adjusts the speeds by the driving motor (Jpn. Pat. Appln. KOKAI Publication No. 2002-311672).

In accordance with the above-described conventional apparatus, two rotational speed fluctuations of the driving motor rotating the photoreceptor drums are read by use of an encoder, and the rotational speed fluctuations are reduced by feedback-controlling the driving motor.

Further, comparison with rotational speed fluctuations of other photoreceptor drums is carried out, and rotational speed fluctuations are synchronized. In such an apparatus, it is necessary to provide a sensor detecting a rotational speed of a photoreceptor drum, and a driving motor for adjusting a rotational speed of each photoreceptor drum, to each of the respective photoreceptor drums. Therefore, a number of components increases, which brings about a high cost.

BRIEF SUMMARY OF THE INVENTION

In order to solve the problems, an object of the present invention is to provide a drum drive unit and an image formation apparatus which are capable of reducing rotational speed fluctuations of photoreceptor drums by using as few components as possible.

In order to solve the problems and to achieve the object, a method for assembling a drum drive unit and an image formation apparatus having the drum drive unit of the present invention are structured as follows.

In order to achieve the above-described object, the assembling method according to the present invention comprises: a plurality of driving force transmission members formed by injection molding; and spots provided at side portions of the driving force transmission members, wherein the spots are disposed so as to be shifted by an arbitrary angle when the driving force transmission members are disposed, and the drum drive unit is assembled in phase that cycles of mesh errors of the driving force transmission members are synchronized.

Further, the image formation apparatus according to the present invention comprises: an image formation unit which forms a developer image on a medium by developing and transcribing an electrostatic latent image; a plurality of photoreceptor drums; a drive unit which drives the photoreceptor drums, a plurality of driving force transmission members which transmit a rotary driving force from the drive unit to the photoreceptor drums, which are formed by injection molding, and which have the same cycle of mesh errors; and marks which are respectively provided at the same portions of the driving force transmission members, wherein the marks are disposed so as to be shifted by an arbitrary angle when the driving force transmission members are disposed, and the drive unit is assembled in phase that cycles of mesh errors of the driving force transmission members are synchronized.

In accordance with the present invention, it is possible to provide an assembling method and an image formation apparatus which are capable of reducing rotational speed fluctuations of the photoreceptor drums by using as few components as possible.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiment 1

Figure 1:
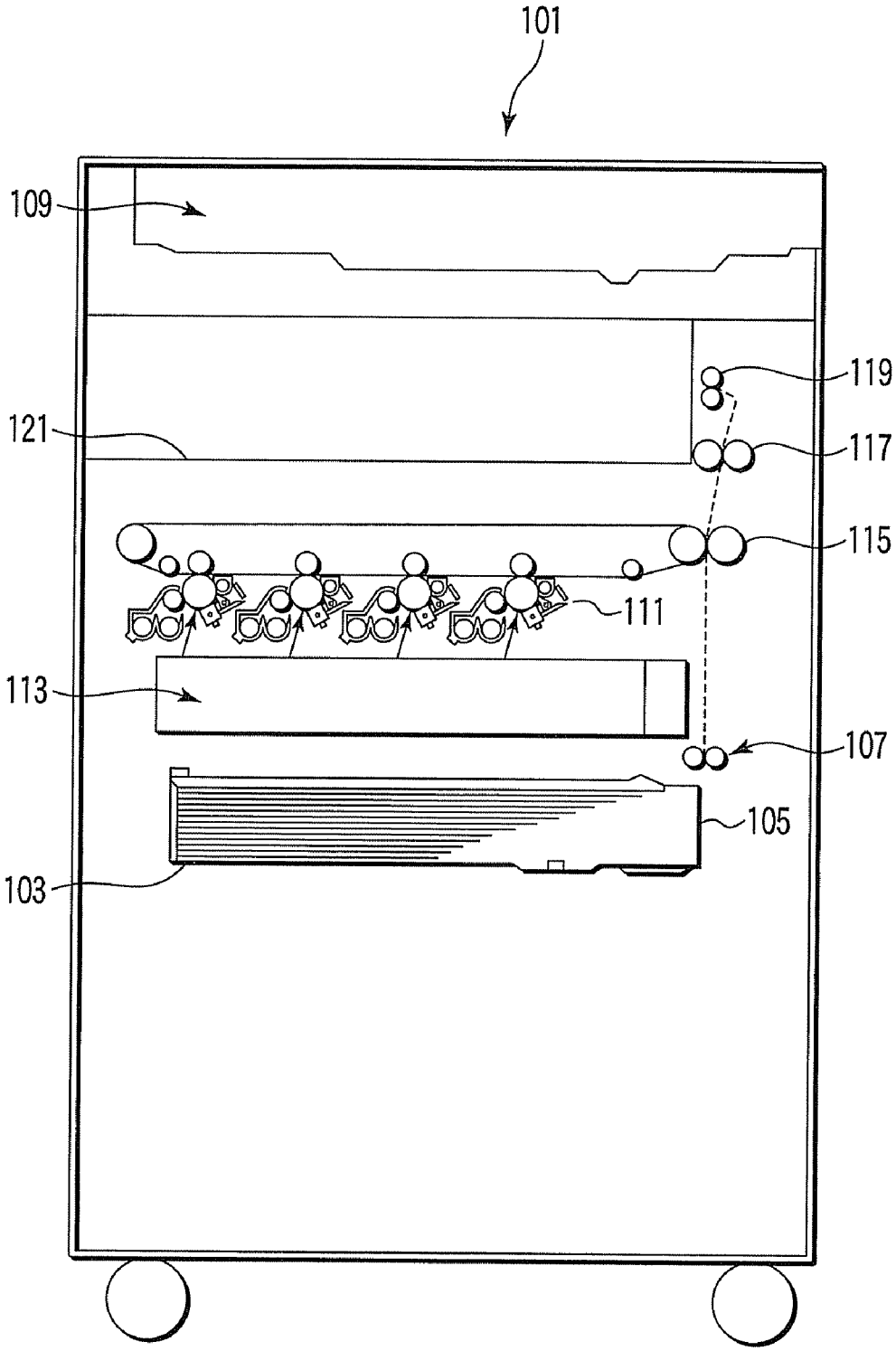
FIG. 1 is an internal block diagram showing an image formation apparatus main body which is one embodiment of the present invention.

FIG. 1 is a schematic block diagram showing a train-of-four tandem system color copier 101 serving as an example of an image formation apparatus to which a belt drive unit according to the embodiment is provided. A paper feeding cassette 105 in which recording media 103 are stored is provided on the lower side of the color copier 101. The recording media 103 are carried to the upper side of the tandem type image formation apparatus main body 101 via a carrier roller 107. There is provided an image scanning unit 109 which scans a manuscript on the upper side of the tandem type image formation apparatus main body 101. Further, there are provided an image formation unit 111 which will be described later and a photolithography device 113 which forms an electrostatic latent image by irradiating a laser beam onto the image formation unit 111 on the basis of information scanned by the image scanning unit 109.

Moreover, a secondary transfer roller 115, a fixing machine 117, a paper ejection roller 119, and a catch tray 121 are provided, and a toner image is transcribed onto the recording medium 103 by the secondary transfer roller 115. The toner image transcribed onto the recording medium 103 is fixed by the fixing machine 117, and thereafter, the recording medium 103 is ejected to the catch tray 121 via the paper ejection roller 119.

Figure 2:
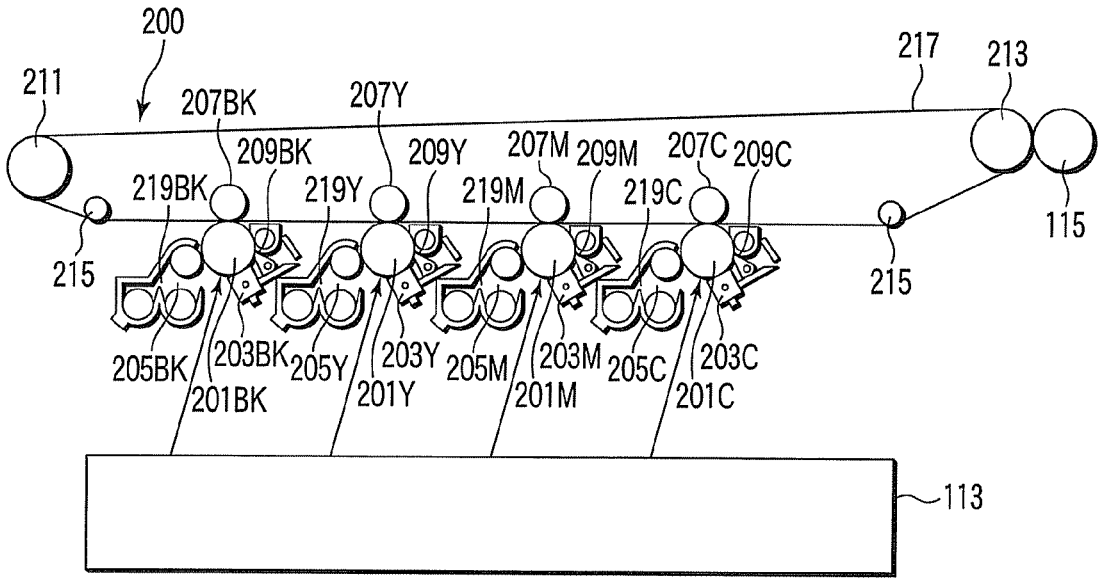
FIG. 2 is a cross-sectional view of a color image formation unit.

FIG. 2 is a cross-sectional view of the image formation unit 111 and a transcription unit 200. The image formation unit 111 is formed from respective image formation units 219BK to 219C. The image formation units 219BK to 219C have photoreceptor drums 201BK to 201C, and electrification chargers 203BK to 203C, developing machines 205BK to 205C, primary transfer rollers 207BK to 207C, and cleaners 209BK to 209C are provided along the rotation direction of the photoreceptor drums 201BK to 201C.

The developing machines 205BK to 205C of the image formation unit 111 are respectively structured to carry out development with a binary developer formed from toners of black (BK), yellow (Y), magenta (M), and cyan (C), and a carrier. The photolithography device 113 forms images on the photoreceptor drums 201BK to 201C through an imaging lens system and the respective mirrors by scanning a laser beam emitted from an unillustrated semiconductor laser element with polygon mirrors in the axis line directions of the photoreceptor drums 201BK to 201C.

An intermediate transfer belt 217 of the transcription unit 200 is stretched onto a driving roller 211, a driven roller 213, and a tension roller 215, and is made to contact the photoreceptor drums 201BK to 201C so as to face those on the upper side of the image formation unit 111. A primary transcriptional position of the intermediate transfer belt 217 is supported by the primary transfer rollers 207BK to 207C which apply a transcriptional voltage for primarily transcribing toner images on the photoreceptor drums 201BK to 201C onto the intermediate transfer belt 217. At a secondary transcriptional position facing the driven roller 213 on which the intermediate transfer belt 217 is stretched, there is provided a secondary transfer roller 115 which applies a transcriptional voltage for secondarily transcribing the toner images primarily transcribed on the intermediate transfer belt 217, onto the recording medium 103.

Next, operations of the respective devices at the time of forming an image will be described. First, when image information is inputted from the image scanning unit 109 or each personal computer terminal at the start of image formation, the respective photoreceptor drums 201BK to 201C are rotated, and a primary image formation process is executed in the image formation unit 111. At a black (BK) image formation unit 219*a*, a photoreceptor drum 201*a* is charged by an electrification charger 203*a*, and a laser beam corresponding to black (BK) image information is irradiated thereon, which forms an electrostatic latent image. Moreover, a black (BK) toner image is formed on the photoreceptor drum 201*a* by a developing machine 205*a*. Next, the photoreceptor drum 201*a* contacts the intermediate transfer belt 217 to primarily transcript the black (BK) toner image onto the intermediate transfer belt 217 with a primary transfer roller 207*a*.

Processes of forming toner images in yellow (Y), magenta (M), and cyan (C) are carried out in the same way as the process of forming the toner image in black (BK), the toner images in yellow (Y), magenta (M), and cyan (C) are transcribed in lager quantity at the same position at which the black (BK) toner image is formed on the intermediate transfer belt 217, and a full-color toner image is obtained on the intermediate transfer belt 217. The recording medium 103 on which the image formation has been completed is ejected to the catch tray 121 via the paper ejection roller 119.

Thereafter, the intermediate transfer belt 217 reaches the position of the secondary transfer roller 115, and the superimposed full-color toner image in black (BK), yellow (Y), magenta (M), and cyan (C) is collectively transcribed secondarily onto the recording medium 103 by a transcriptional bias of the secondary transfer roller 115.

The recording medium 103 is fed to the position of the secondary transfer roller 115 from the paper feeding cassette 105 in synchronization with a time when the full-color toner image on the intermediate transfer belt 217 reaches the secondary transfer roller 115. Thereafter, the full-color toner image is fixed onto the recording medium 103 by the fixing machine 117. On the other hand, with respect to the photoreceptor drums 201BK to 201C which have primarily transcribed the toner images onto the intermediate transfer belt 217, the residual toners are eliminated by the cleaners 209BK to 209C, which makes it possible to carry out the following image formation processes.

Figure 3:
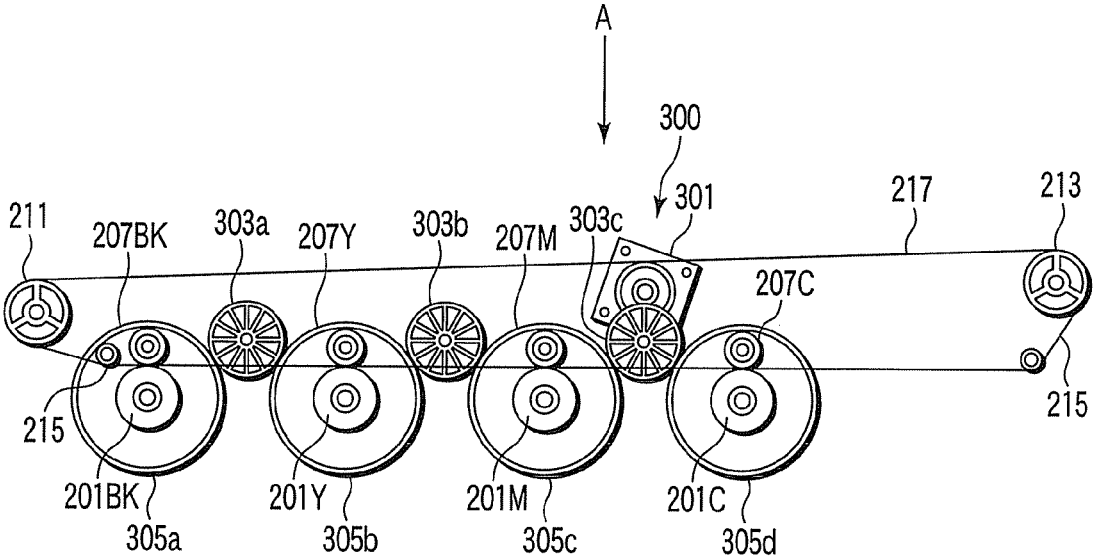
FIG. 3 is a side view of a drum drive unit according to a first embodiment of the present invention.

Next, a drum drive unit 300 driving the photoreceptor drums 201BK to 201C of the transcription unit 200 will be described with reference to FIG. 3. FIG. 3 is a diagram showing the drum drive unit 300 as a model.

The drum drive unit 300 is structured from a driving motor 301 serving as a drive unit, drum gears 305*a* to 305*d* serving as driving force transmission members, and idler gears 303*a* to 303*c*.

The drum gear 305*a* is provided on the rotary shaft of the photoreceptor drum 201BK, and the photoreceptor drum 201BK is rotated in accordance with a rotation of the drum gear 305*a*. In the same way as this, the drum gears 305*b* to 305*d* are respectively provided on the rotary shafts of the photoreceptor drums 201Y to 201C, and the photoreceptor drums 201Y to 201C are rotated in accordance with rotations of the drum gears 305*b* to 305*d*.

Further, the idler gear 303*a* is engaged between the drum gear 305*a* and the drum gear 305*b*. In the same way, the idler gear 303*b* is engaged between the drum gear 305*b* and the drum gear 305*c*, and the idler gear 303*c* is engaged between the drum gear 305*c* and the drum gear 305*d*.

Moreover, the driving motor 301 is engaged with the idler gear 303*c*, and a driving force is supplied form the driving motor 301 to the idler gear 303*c*.

Here, the drum gears 305*a* to 305*d* and the idler gears 303*a* to 303*c* are manufactured by injection molding using synthetic resins.

Operations of the drum drive unit 300 of the present embodiment will be described. When the driving motor 301 is rotated, a driving force is transmitted to the idler gear 303*c* engaged with the driving motor 301, and the idler gear 303*c* is rotated. When the idler gear 303*c* is rotated, the drum gears 305*c* and 305*d* engaged with the idler gear 303*c* are rotated.

Then, the idler gear 303*b* engaged with the drum gear 305*c* is rotated by the rotation of the drum gear 305*c*. When the idler gear 303*b* is rotated, the drum gear 305*b* engaged with the idler gear 303*b* is rotated. The idler gear 303*a* engaged with the drum gear 305*b* is rotated by the rotation of the drum gear 305*b*, and the drum gear 305*a* engaged with the idler gear 303*a* is rotated by the rotation of the idler gear 303*a*.

As described above, the driving force of the driving motor 301 is transmitted by the respective drum gears 305*a* to 305*d*, and the idler gears 303*a* to 303*c*. The photoreceptor drums 201BK to 201C on the rotary shafts of the drum gears 305*a* to 305*d* are rotated by the rotations of the drum gears 305*a* to 305*d*.

Figure 4:
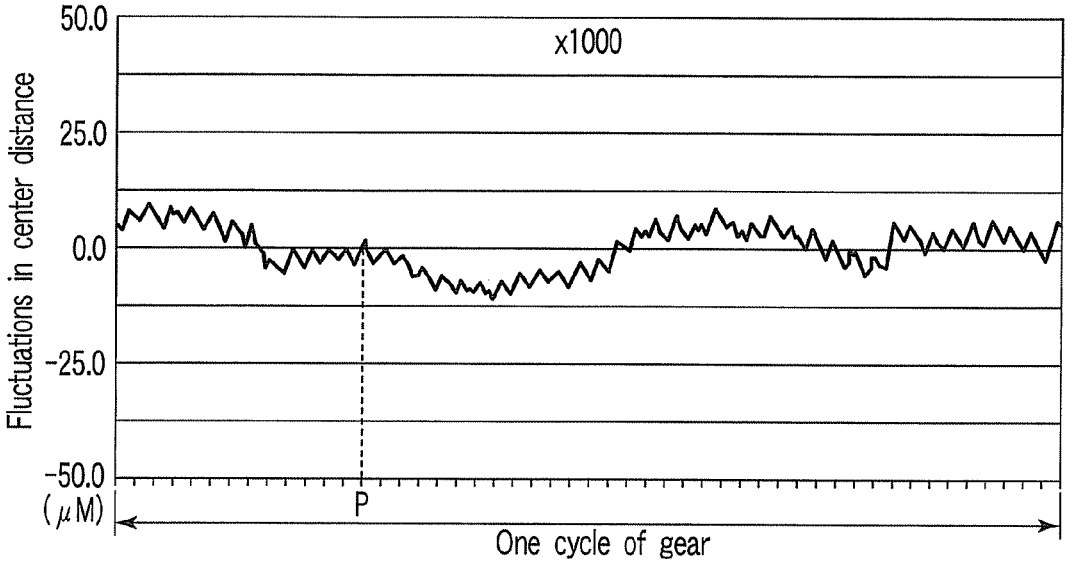
FIG. 4 is a diagram showing measured results of measurement of mesh errors.

Next, how to synchronize the rotational speed fluctuations of the drum drive unit 300 will be described by use of FIGS. 5A and 5B. Here, in the present embodiment, it is assumed that the photoreceptor drums 201BK to 201C are always simultaneously driven, and there are no fluctuations in mesh errors of the idler gears 303*a* to 303*c* of the present embodiment, and there are no fluctuations in pitch circle radii of the gears. As the drum gears 305*a* to 305*d*, gears having the same mesh errors shown in FIG. 4 are respectively used. How to synchronize the rotational speed fluctuations of the drum gears 305*a* to 305*d* engaged with the idler gears 303*a* to 303*c* without variations in mesh errors will be described.

First, spots 601 are marked at the side faces of the respective drum gears of the present embodiment. It is assumed that those spots are at the position of P in FIG. 4.

Figure 5A:
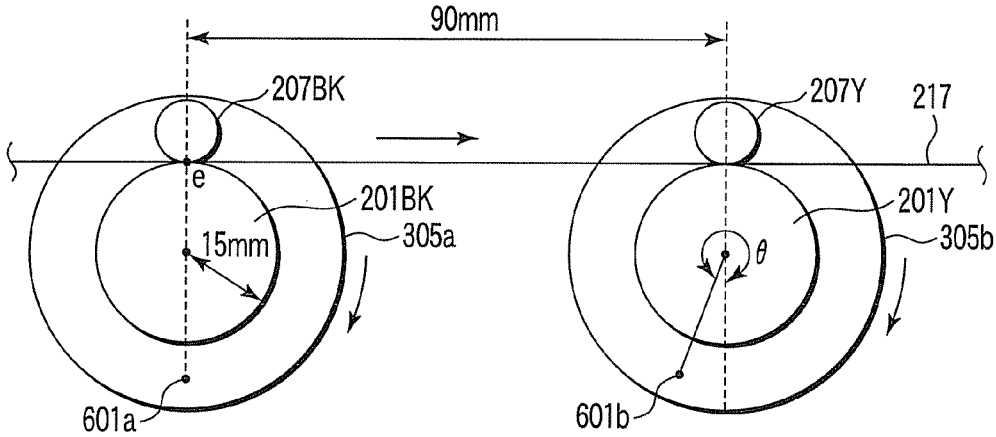
FIGS. 5A and 5B are diagrams for explanation of a method for assembling the drum drive unit.

Next, as shown in FIG. 5A, an arbitrary point on the intermediate transfer belt 217 is set to a transcription point e. As shown in FIG. 5A, it is assumed that this transcription point e is at a nip portion at which the photoreceptor drum 201BK and the primary transfer roller 207BK contact each other through the intermediate transfer belt 217. At this time, it is assumed that a spot 601*a* of the drum gear 305*a* is at a position shifted by 180° from the transcription point e.

Figure 5B:
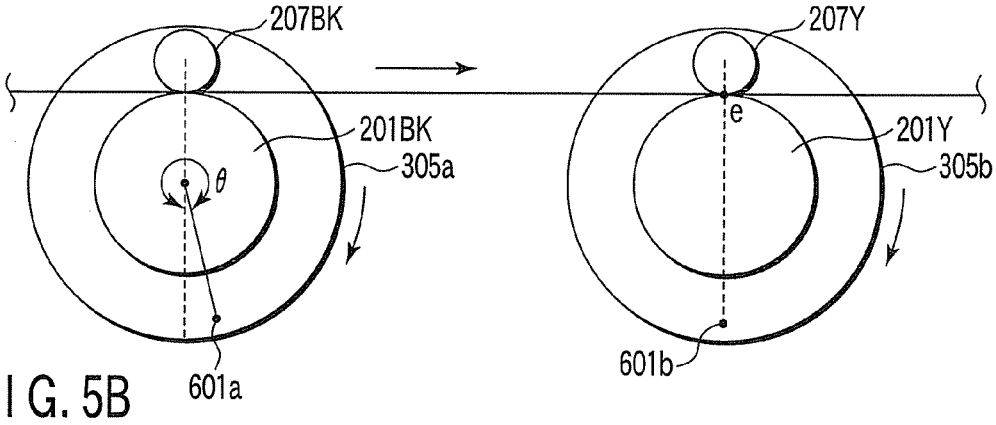

Next, as shown in FIG. 5B, it is assumed that the point e on the intermediate transfer belt as well moves in accordance with a movement of the intermediate transfer belt 217, and the point e reaches the nip portion between the photoreceptor drum 201Y and the primary transfer roller 207Y. At this time, it is controlled such that a spot 601*b* of the drum gear 305*b* comes to a position shifted by 180° from the transcription point e. In this manner, the drum gears 305*a* and 305*b* are made to be in phase, which makes it possible to eliminate the influence of rotational speed fluctuations due to mesh errors.

Here, it is assumed that a center distance between the photoreceptor drum 201BK and the photoreceptor drum 201Y in the present embodiment is, for example, 90 mm. Further, given that a radius of the photoreceptor drum in the present embodiment is, for example, 15 mm, and rotational speeds of the photoreceptor drums and the drum gears are the same, a phase difference θ between the drum gears 305BK and 305Y is 343.80. When the transcription point e proceeds by 90 mm in accordance therewith, the drum gears rotate by 343.8°.

As shown in FIGS. 5A and 5B, when the transcription point e at the nip portion between the photoreceptor drum 201BK and the primary transfer roller 207BK reaches the nip portion between the photoreceptor drum 201Y and the primary transfer roller 207Y, the drum gears 305BK and 305Y rotate by θ (343.8°).

Figure 6:
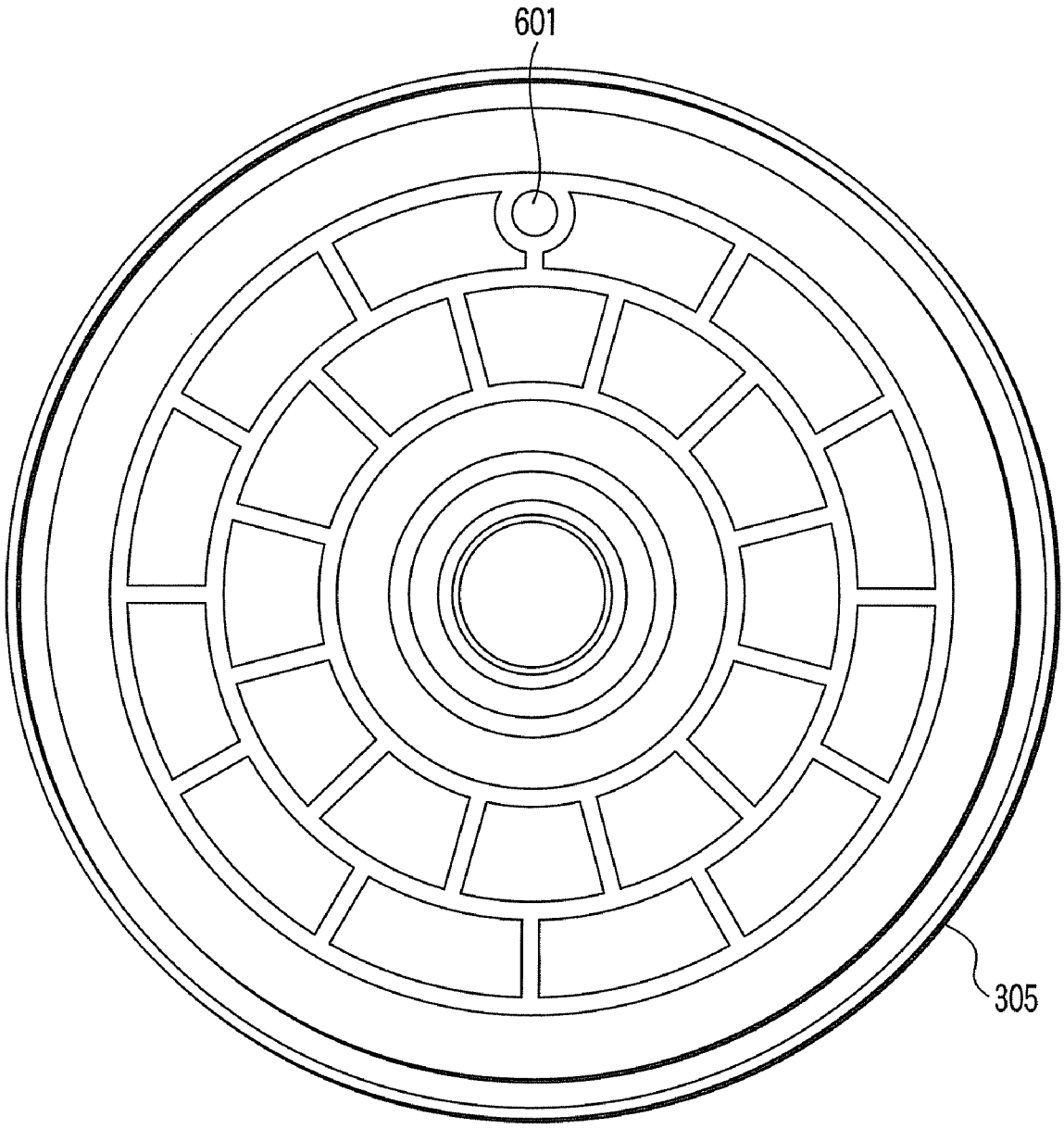
FIG. 6 is a diagram for explanation of a method for attaching drum gears at the time of assembling the drum drive unit.

This ensures that it suffices to carry out the assembly such that reference points are provided at the same position of the drum gears 305*a* to 305*d*, and the phases of the respective reference points are shifted by 343.8°. For example, as shown in FIG. 6, the spots 601 are marked on the side faces of the respective drum gears 305*a* to 305*d*. The assembly is carried out such that the phases of the respective drum gears 305*a* to 305*d* are made to be specified phases by using the spots.

In the present embodiment, it is assumed that a center distance among the respective photoreceptor drums 201BK to

201C is 90 mm, and a radius of the photoreceptor drum is 15 mm. For example, given that a center distance is L, and a radius of the photoreceptor drum is r, and a phase difference is θ(rad), $\theta=(L/2\pi r)\times 360°\times(\pi/180°)$, which formulates an equation of $\theta=L/r$. In assembling, a phase difference is determined by the aforementioned equation on the basis of the center distance among the respective photoreceptor drums and the radius of the photoreceptor drum. Then, it suffices to carry out the assembly such that the reference points b provided to the respective drum gears 305*a* to 305*d* are shifted by the phase difference.

In this way, in a tandem type image formation apparatus in which the respective photoreceptor drums 201BK to 201C are always simultaneously driven, cycles of rotational speed fluctuations of the respective photoreceptor drums 201BK to 201C are synchronized in assembling the respective photoreceptor drums 201BK to 201C. In this manner, a driving operation is carried out in a state in which cycles of rotational speed fluctuations of the respective photoreceptor drums 201BK to 201C which have been assembled are always synchronized, and therefore, it suffices to carry out the assembly such that cycles of rotational speed fluctuations of the respective photoreceptor drums 201BK to 201C are synchronized in assembling.

When the respective photoreceptor drums 201BK to 201C are always simultaneously driven, there is no need to adjust rotational speed fluctuations after assembling, and there is no need to provide a device which detects a rotational speed of a photoreceptor drum, or detects a reference position, or the like, which makes it possible to simplify the structure, and to realize a cost reduction.

Embodiment 2

As another embodiment, when the respective photoreceptor drums are separately driven, how to synchronize the cycles of rotational speed fluctuations of the respective photoreceptor drums of the drum drive unit of the tandem type image formation apparatus having, for example, a print function for black, will be described.

After printing for black is completed, the black color photoreceptor drum is stopped. When a print request for color printing is issued in this state, a problem is brought about in image formation because cycles of rotational speed fluctuations of the black color photoreceptor drum and the other color photoreceptor drums have not been synchronized.

Figure 7A:
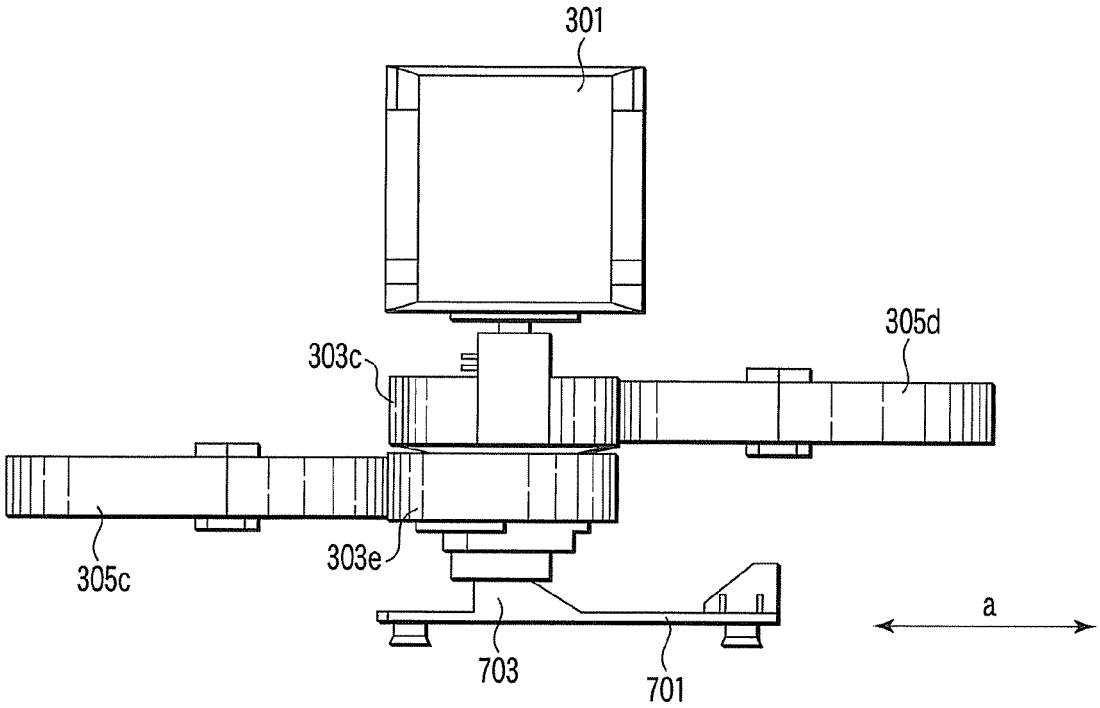
FIGS. 7A and 7B are top views of a belt drive unit according to a second embodiment.
Figure 7B:
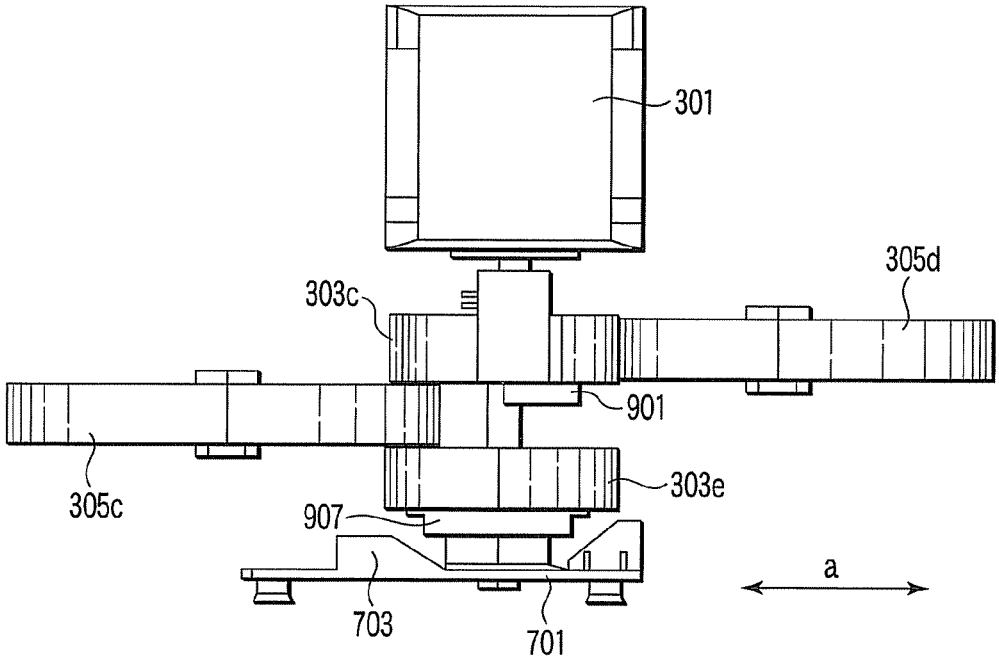

Here, first, the structure of the drum drive unit for driving only the black color photoreceptor drum independently of the other color photoreceptor drums will be described by use of FIGS. 7A and 7B. FIGS. 7A and 7B are diagrams in which the driving motor 301, the first idler gear 303*c*, the second idler gear 303*e*, and the drum gears 305*c* and 305*d* in the drum drive unit are viewed from the arrow direction of FIG. 3.

Further, in the present embodiment, it is assumed that the photoreceptor drum 201C is provided coaxially with the drum gear 305*a*, the photoreceptor drum 201M is provided coaxially with the drum gear 305*b*, the photoreceptor drum 201Y is provided coaxially with the drum gear 305*c*, and the photoreceptor drum 201BK is provided coaxially with the drum gear 305*d*.

In the present embodiment, as shown in FIGS. 7A and 7B, and FIGS. 8A and 8B, the idler gear 303*e* is provided so as to be movable in the axial direction on the rotary shaft extension of the idler gear 303*c* transmitting a rotation of the driving motor 301. Here, the idler gear 303*c* is provided so as not to be driven by a rotation of the rotary shaft. The idler gear 303*c* is engaged with the drum gear 305*d*. Further, a guide 701 and a pressing member 703 serving as switching transmission means are provided to the tip of the rotary shaft of the idler gear 303*c*. The guide 701 is provided so as to be movable in the direction of arrow a in the drawing by an unillustrated moving mechanism.

Figure 8A:
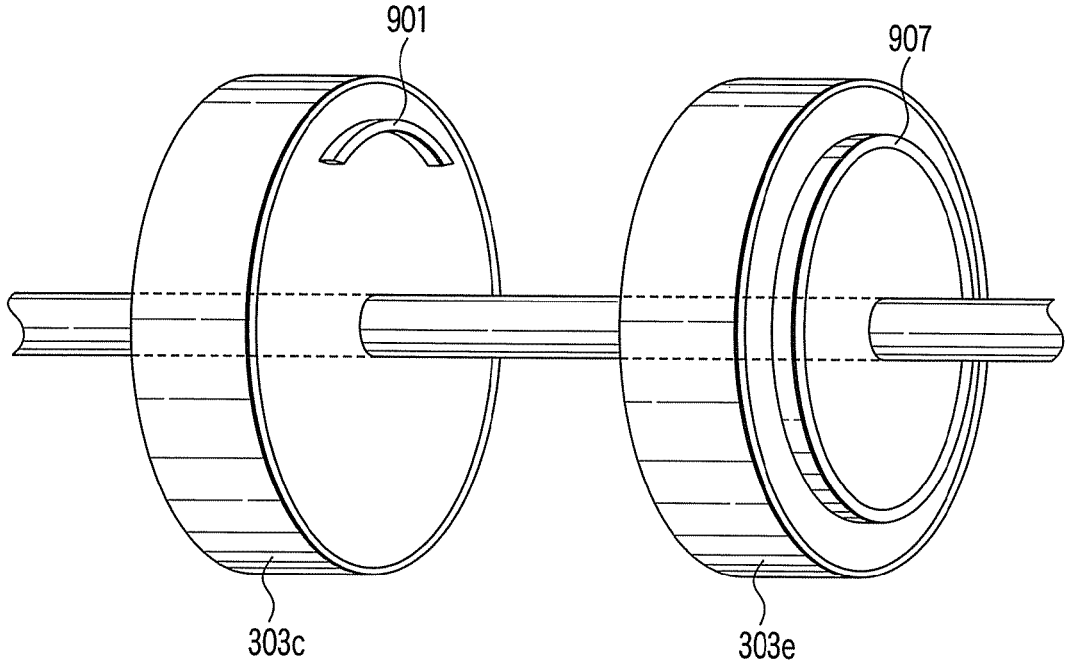
FIGS. 8A and 8B are diagrams for explanation of idler gears used for the belt drive unit according to the second embodiment.
Figure 8B:
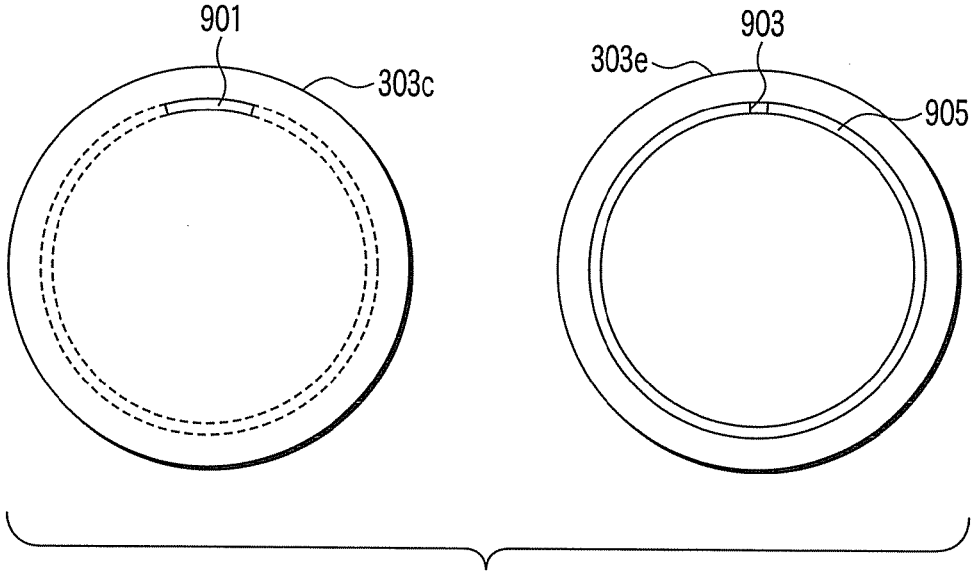

Next, the idler gears 303*c* and 303*e* used for the present embodiment will be described. As shown in FIGS. 8A and 8B, a protruding portion 901 is provided to a side face of the idler gear 303*c*. Then, a slot 905 is provided to a portion corresponding to a locus obtained when the protruding portion 901 is rotated (the dotted line portion in FIG. 8B) at the side face of the idler gear 303*c*, and a rib 903 is provided to a part of the slot 905. Then, a circular rib 907 protruding from the side face of the idler gear 303*c* is provided to the side face opposite to the side at which the slot 905 is provided.

Here, a position of the rib 903 will be described. As will be described later, when the idler gear 303*c* starts rotating due to the idler gear 303*c* and the idler gear 303*e* touching each other, the protruding portion 901 moves along the slot 905, and the idler gear 303*e* starts rotating due to the protruding portion 901 touching the rib 903. At this time, the rib 903 is provided at a position at which it is possible to synchronize rotational speed fluctuations between the black color photoreceptor and the color photoreceptors and it is possible for the idler gear 303*e* to obtain a driving force from the idler gear 303*c*.

Next, operations of the present embodiment will be described. First, when a print request for printing for black is issued, the guide 701 moves to a position at which the pressing member 703 does not touch the circular rib 907 as shown in FIG. 7B. Moreover, the guide 701 separates the idler gear 303*c* and the idler gear 303*e* with an unillustrated separating mechanism. The engagement of the idler gear 303*e* with the drum gear 305*c* is cancelled on separation from the idler gear 303*c*. Next, the driving motor 301 starts rotating, and a driving force from the driving motor 301 is transmitted to the idler gear 303*c*, and the drum gear 305*d* is rotated by a rotation of the idler gear 303*c*. On the other hand, because the drum gear 305*c* is not engaged with the idler gear 303*e*, it is impossible to obtain a driving force, which makes it impossible for the drum gear 305*c* to rotate. Therefore, a motive power is not transmitted to the color photoreceptor drums, which leads to a stopped state. In accordance therewith, a driving force is transmitted to only the drum gear 305*d*, and printing only in black is possible.

Next, when a request for color printing is issued, as shown in FIG. 7A, the guide 701 moves, and the pressing member 703 presses the circular rib 907. The idler gear 303*e* is shifted in the direction of the idler gear 303*c* by pressing the circular rib 907, and the idler gear 303*e* and the idler gear 303*c* touch each other. At this time, the protruding portion 901 provided to the idler gear 303*c* is inserted into the slot 905 provided to the idler gear 303*e*.

At this point in time, the driving motor 301 starts rotating. The idler gear 303*c* starts rotating by the rotation of the driving motor 301. The drum gear 305*d* is rotated by the rotation of the idler gear 303*c*. At this time, a driving force is not transmitted to the idler gear 303*e*, and the idler gear 303*e* is not rotating.

Here, when the idler gear 303*c* is rotated, the protruding portion 901 as well rotates along the slot 905. When the protruding portion 901 rotates to touch the rib 903 in the slot 905, the idler gear 303*e* starts rotating by receiving a driving force from the idler gear 303*c*.

The idler gear 303*e* is, as described above, structured so as to start rotating at a position at which it is possible to synchronize rotational speed fluctuations between the black color photoreceptor drum and the color photoreceptor drums. Thus, even when the printing for black has been completed, the black color photoreceptor drum is stopped at a position at which synchronizing with the color photoreceptor drums has not been carried out, and a request for color printing is issued in this state, the idler gear 303*c* and the idler gear 303*e* touch each other by the movement of the holder. However, because the idler gear 303*e* is to start rotating by being engaged with the idler gear 303*c* at a position at which it is possible to synchronize the cycle of rotational speed fluctuations of the color photoreceptor drums, it is possible to synchronize the cycles of rotational speed fluctuations of all the photoreceptor drums, which makes it possible to execute satisfactory image formation.

Embodiment 3

Figure 9A:
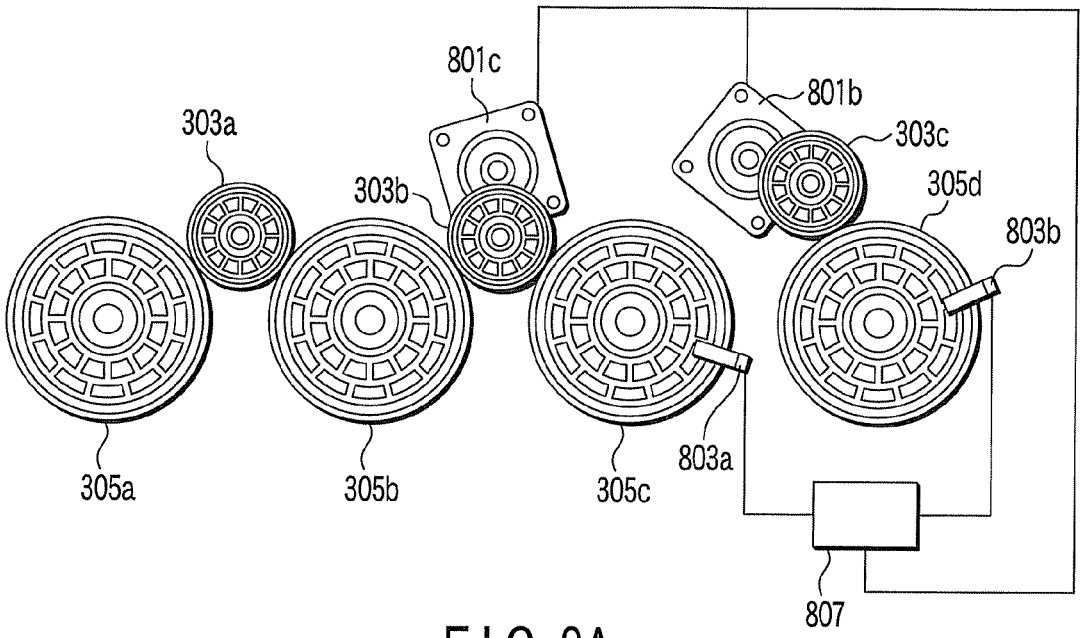
FIGS. 9A and 9B are diagrams for explanation of a belt drive unit according to a third embodiment.

As a third embodiment, how to synchronize the cycles of rotational speed fluctuations of the respective photoreceptor drums of the drum drive unit having two or more driving motors will be described. FIG. 9A is a cross-sectional view showing structures of only driving motors 801 (801*b*, 801*c*), the idler gears 303 (303*a*, 303*b*, 303*c*) serving as driving force transmission members, and the drum gears 305 (305*a*, 305*b*, 303*c*, 305*d*) in the drum drive unit in order to simplify the description.

Figure 9B:
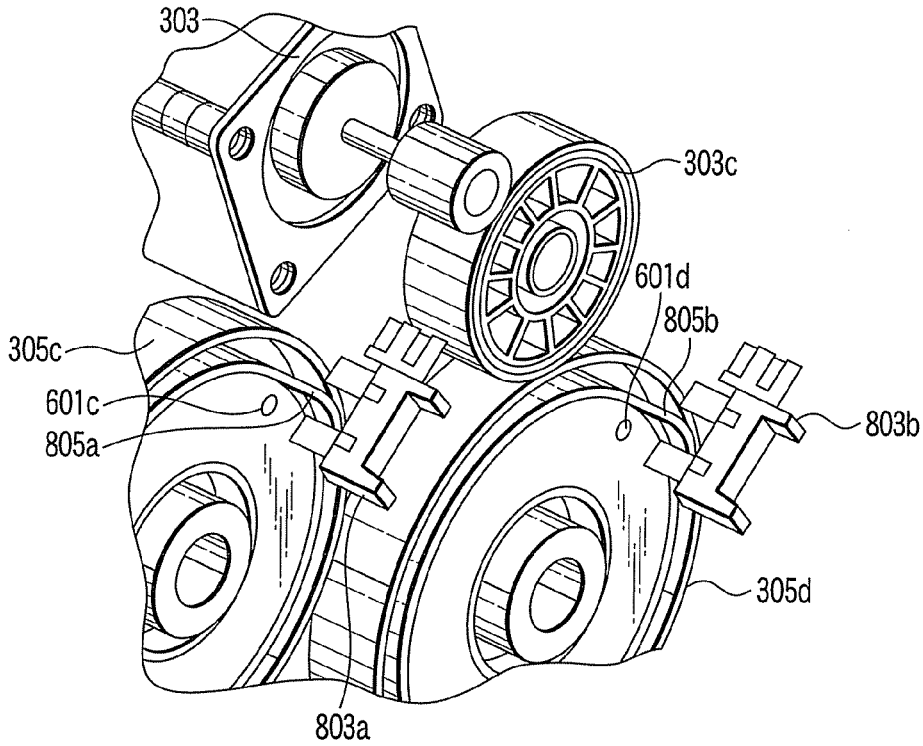

FIG. 9B is an enlarged view of the vicinity of the driving motor 801*c* in FIG. 9A. As shown in FIG. 9A, for example, the drum drive unit is structured such that two driving motors of the driving motor 801*b* for driving the black color photoreceptor drum and the driving motor 801*c* for driving the color photoreceptor drums are provided.

Because the color photoreceptor drums have one driving motor therefor, provided that the unit is assembled so as to be able to synchronize the cycles of rotational speed fluctuations of the respective photoreceptor drums in assembling, there is no need to carry out adjustment for synchronizing thereafter. However, because the black color photoreceptor drum has one driving motor for driving it, it is necessary to synchronize the cycles of rotational speed fluctuations when all the photoreceptor drums for black and the colors are driven.

Then, as shown in FIG. 9B, as sensing means for sensing a stopping position of a drum gear, a photo interrupter 803*a* is provided to the drum gear 305*c*, and a photo interrupter 803*b* is provided to the drum gear 305*d*. Further, a protruding portion 805*a* is provided so as to be sensed by the photo interrupter 803*a*, at the position of the spot 601*c* on the side face of the drum gear 305*c*. In the same way, a protruding portion 805*b* is provided at the position of the spot 601*d* on the side face of the drum gear 305*d*.

The photo interrupters 803 (803*a*, 803*b*) are connected to the driving motors 801 (801*b*, 801*c*) via a control device 807. The protruding portion 805*a* provide to the drum gear 305*c* is sensed by the photo interrupter 803*a*, and the protruding portion 805*b* provide to the drum gear 305*d* is sensed by the photo interrupter 803*b*. For example, the photo interrupters 803 (803*a*, 803*b*) are provided at the positions shown in FIG. 9A.

The photo interrupter 803*b* is provided so as to be shifted by a phase difference θ from the position at which the photo interrupter 803*a* is provided. This phase difference θ is calculated by the equation described in the embodiment 1. When the respective photoreceptor drums are stopped after driving, the protruding portions 805*a* and 805*b* are controlled to respectively stop at the positions of the photo interrupters 803*a* and 803*b* by the control device 807.

In this manner, because all the photoreceptor drums are rotated while synchronizing the rotational speed fluctuations even when a next print request is issued, satisfactory image formation is possible.

Further, drum flanges built in the photoreceptor drums are eccentrically located to no small extent, which causes fluctuations in the rotation cycles of the drums. The drum flanges are structured to be assembled from only one direction, and moreover, the connection with the driving side is restricted to being from one direction, and those are structured so as to synchronize the cycles of rotational speed fluctuations described above. Due to the drum flanges assembled in this way, it is possible to reduce color shift.

Embodiment 4

Figure 10:
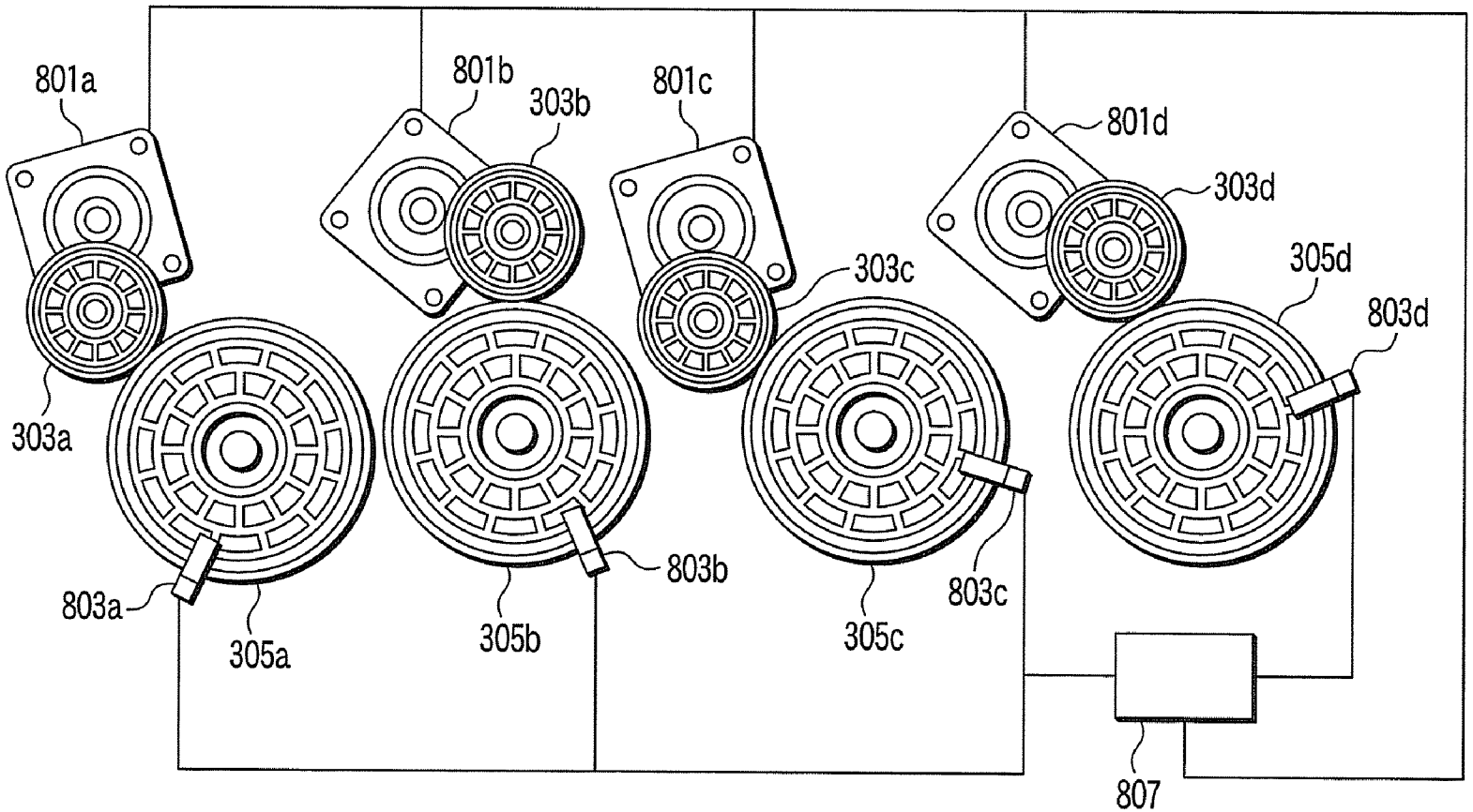
FIG. 10 is a diagram for explanation of a belt drive unit according to a fourth embodiment.

As a fourth embodiment, how to synchronize the cycles of rotational speed fluctuations of the respective photoreceptor drums of the drum drive unit having four driving motors will be described. FIG. 10 is a cross-sectional view showing structures of only driving motors 801 (801*a* to 801*d*), the idler gears 303 (303*a* to 303*d*) serving as driving force transmission members, and the drum gears 305 (305*a* to 305*d*) in the drum drive unit in order to simplify the description.

In the present embodiment, as sensing means for sensing a stopping position of the drum gears, photo interrupters 803*a* to 803*d* are provided to the drum gears 305*a* to 305*d*, respectively. Further, protruding portions are provided so as to be sensed by the photo interrupters 803*a* to 803*d*, at the positions of the spots on the side faces of the drum gears 305*a* to 305*d*.

The photo interrupters 803*a* to 803*d* are connected to the driving motors 801*a* to 801*d* via the control device 807. The protruding portions provided to the drum gears 305*a* to 305*c* are sensed by these photo interrupters 803*a* to 803*d*.

The photo interrupter 803*b* is provided so as to be shifted by a phase difference θ from the position at which the photo interrupter 803*a* is provided. This phase difference θ is calculated by the equation described in the embodiment 1. When the respective photoreceptor drums are stopped after driving, the protruding portions 805*a* and 805*b* are controlled so as to respectively stop at the positions of the photo interrupters 803*a* and 803*b* by the control device 807. In the same way, positions of the photo interrupters 803*c* and 803*d* are determined.

In this manner, because all the photoreceptor drums are rotated while synchronizing the cycles of rotational speed fluctuations even when a next print request is issued, satisfactory image formation is possible.

Further, drum flanges built in the photoreceptor drums are eccentrically located to no small extent, which causes fluctuations in the rotation cycles of the drums. The drum flanges are structured so as to be assembled from only one direction, and the connection with the driving side is restricted to being from one direction, and those are structured so as to synchronize the cycles of rotational speed fluctuations described above. Due to the drum flanges assembled in this way, it is possible to reduce color shift.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for assembling a drum drive unit comprising:

disposing a plurality of drums which are separated from each other with a predetermined center distance, said drums carrying a belt body by making the belt body contact outer peripheral surfaces thereof;

disposing driving force transmission members respectively on rotary shafts of the plurality of drums coaxially with the rotary shafts, each of the driving force transmission members having the same fluctuations per round in a distance between the center of rotation and the driving force transmission position, the fluctuations forming a cycle of fluctuations;

obtaining a rotation angle of the drum when the belt body is made to contact the drum and carried for a distance which is equal to the center distance;

calculating a difference in the angle between the rotation angle and 360 degrees; and positioning and assembling each of the driving force transmission members by shifting a certain point in the cycle of fluctuations of the driving force transmission members by the difference in the angle.

2. The method for assembling a drive unit according to claim 1, wherein the driving force transmission members have spots at positions which are end faces in an axial direction, and are spaced from the rotary shafts, and when the adjacent driving force transmission members are disposed so as to be shifted each other by the measures of rotation angles, the positioning is carried out on the basis of the spots.

3. The method for assembling a drive unit according to claim 1, wherein the driving force transmission members are molded by use of the same metallic mold.

4. The method for assembling a drive unit according to claim 3, wherein molds for the spots are formed at positions of the metallic mold corresponding to portions which are end faces in an axial direction of the driving force transmission members, and are spaced from the rotary shafts.

5. The method for assembling a drive unit according to claim 1, wherein the cycles of fluctuations are based on mesh errors of the driving force transmission members.

6. The method for assembling a drive unit according to claim 1, wherein the cycles of fluctuations are based on errors in shapes of the driving force transmission members.

7. An image formation apparatus comprising:

an image formation unit which forms a developer image on a medium by developing and transcribing an electrostatic latent image;

a plurality of photoreceptor drums each having a rotary shaft separated from each other with a predetermined center distance and carry a belt body by making the belt body contact outer peripheral surfaces thereof;

a plurality of drum gears which are respectively provided coaxially with the rotary shafts of the photoreceptor drums, the drum gears being configured to rotate by measures of rotational angles which are the same as measures of rotational angles of the photoreceptor drums;

a drive unit which drives the photoreceptor drums; and a plurality of idler gears which mesh with the drum gears and transmit a driving force from the drive unit to the drum gears, wherein each of the drum gears has the same values in the fluctuations per round in a distance between the center of rotation of the drum gears and the driving force transmission position, the fluctuations forming a cycle of fluctuations, and the drum gears are assembled by shifting a certain point in the cycle of fluctuations by a difference in the angle between 360 degrees and the rotation angle of the photoreceptor drums when the belt body is carried for a distance which is equal to the center distance.

8. The image formation apparatus according to claim 7, wherein the driving force transmission members have spots at positions which are end faces in an axial direction, and are spaced from the rotary shafts, and when the adjacent driving force transmission members are disposed so as to be shifted each other by the measures of rotation angles, the positioning is carried out on the basis of the spots.

9. The image formation apparatus according to claim 7, wherein the driving force transmission members are molded by use of the same metallic mold.

10. The image formation apparatus according to claim 7, wherein molds for the spots are formed at positions of the metallic mold corresponding to portions which are end faces in an axial direction of the driving force transmission members, and are spaced from the rotary shafts.

11. The image formation apparatus according to claim 7, wherein the cycles of fluctuations are based on mesh errors of the driving force transmission members.

12. The image formation apparatus according to claim 7, wherein the cycles of fluctuations are based on errors in shapes of the driving force transmission members.

13. The image formation apparatus according to claim 7, wherein the photoreceptor drums have a black color photoreceptor drum and color photoreceptor drums, and switching transmission means for transmitting a driving force to only the black color photoreceptor drum in a case of printing for black, and for transmitting a driving force to the black color photoreceptor drum and the color photoreceptor drums in a case of color printing, and the color photoreceptor drums are assembled such that cycles of mesh errors are synchronized, and when color printing is carried out, the black color photoreceptor drum and the color photoreceptor drums are rotated so as to synchronize cycles of mesh errors by the driving force transmission members and the switching transmission means.

14. The image formation apparatus according to claim 7, wherein the photoreceptor drums have a black color photoreceptor drum and color photoreceptor drums, the drive unit has a first drive unit which drives the black color photoreceptor drum, and a second drive unit which drives the color photoreceptor drums, and the apparatus further comprises:

sensing means for sensing stopping positions of the driving force transmission members, which is provided to the driving force transmission members; and a control device which controls stopping positions of the black color photoreceptor drum and the color photoreceptor drums by sensor signals from the sensing means.

15. An image formation apparatus comprising:

an image formation unit which forms a developer image on a medium by developing and transcribing an electrostatic latent image;

a plurality of photoreceptor drums each having a rotary shaft separated from each other with a predetermined center distance and carry a belt body by making the belt body contact outer peripheral surfaces thereof;

a plurality of drum gears which are respectively provided coaxially with the rotary shafts of the photoreceptor drums, the drum gears being configured to rotate by measures of rotational angles which are the same as measures of rotational angles of the photoreceptor drums;

a drive unit which drives the photoreceptor drums;

a first idler gear which is provided coaxially with a drive shaft of the drive unit and meshes with a black color photoreceptor drum;

a second idler gear which is provided coaxially with the drive shaft of the drive unit and meshes with a color photoreceptor drum which is adjacent to the black color photoreceptor drum, wherein each of the drum gears has the same values in the fluctuations per round in a distance between the center of rotation of the drum gears and the driving force transmission position, the fluctuations forming a cycle of fluctuations, and the drum gears are assembled by shifting a certain point in the cycle of fluctuations by a difference in the angle between 360 degrees and the rotation angle of the photoreceptor drums when the belt body is carried for a distance which is equal to the center distance, and the first idler gear has a protruding portion on a side face, and the second idler gear has a circular rib on one side face thereof and a slot and a rib provided to one part of the slot on the other side thereof.

16. The image formation apparatus according to claim 15, wherein the driving force transmission members have spots at positions which are end faces in an axial direction, and are spaced from the rotary shafts, and when the adjacent driving force transmission members are disposed so as to be shifted each other by the measures of rotation angles, the positioning is carried out on the basis of the spots.

17. The image formation apparatus according to claim 15, wherein the driving force transmission members are molded by use of the same metallic mold.

18. The image formation apparatus according to claim 15, wherein molds for the spots are formed at positions of the metallic mold corresponding to portions which are end faces in an axial direction of the driving force transmission members, and are spaced from the rotary shafts.

19. The image formation apparatus according to claim 15, wherein the cycles of fluctuations are based on mesh errors of the driving force transmission members.

20. The image formation apparatus according to claim 15, wherein the cycles of fluctuations are based on errors in shapes of the driving force transmission members.

* * * * *